US005366565A

United States Patent [19]

Jackson

[11] Patent Number: 5,366,565

[45] Date of Patent: Nov. 22, 1994

[54] NBTIALCRHF ALLOY AND STRUCTURES

[75] Inventor: Melvin R. Jackson, Niskayuna, N.Y.

[73] Assignee: General Electric Company, Schenectady, N.Y.

[21] Appl. No.: 25,497

[22] Filed: Mar. 3, 1993

[51] Int. Cl.[5] ..... C22C 27/00

[52] U.S. Cl. ..... 148/426; 148/422; 420/580

[58] Field of Search ..... 420/426, 580, 422

[56] References Cited

U.S. PATENT DOCUMENTS

| | | | |
|---|---|---|---|
| 3,753,699 | 8/1973 | Anderson, Jr. et al. | 420/426 |
| 4,904,546 | 2/1990 | Jackson | 428/662 |
| 4,931,254 | 6/1990 | Jackson | 420/426 |
| 4,956,144 | 9/1990 | Jackson et al. | 420/426 |
| 4,990,308 | 2/1991 | Jackson | 420/426 |
| 5,006,307 | 4/1991 | Jackson | 420/426 |
| 5,019,334 | 5/1991 | Jackson | 420/426 |
| 5,026,522 | 6/1991 | Jackson et al. | 420/580 |

OTHER PUBLICATIONS

S. T. Wlodek, "The Properties of Cb-Ti-W Alloys, Part I", Oxidation Columbium Metallurgy, D. Douglass and F. W. Kunz, eds., AIME Metallurgical Society Conferences, vol. 10, Interscience Publishers, New York (1961), pp. 175-204.

S. T. Wlodek, "The Properties of Cb-Al-V Alloys, Part I", Oxidation ibid., pp. 553-584.

S. Priceman and L. Sama, "Fused Slurry Silicide Coatings for the Elevated Temperature Oxidation of Columbium Alloys", Refractory Metals and Alloys IV—TMS Conference Proceedings, French Lick, Ind., Oct. 3-5, 1965, vol. II, R. I. Jaffee, G. M. Ault, J. Maltz, and M. Semchyshen, eds., Gordon and Breach Science Publisher, New York (1966) pp. 959-982.

M. R. Jackson and K. D. Jones, "Mechanical Behavior of Nb-Ti Base Alloys", Refractory Metals: Extraction, Processing and Applications, K. C. Liddell, D. R. Sadoway, and R. G. Bautista, eds., TMS, Warrendale, Pa. (1990) pp. 311-320.

M. R. Jackson, K. D. Jones, S. C. Huang, and L. A. Peluso, "Response of Nb-Ti Alloys to High Temperature Air Exposure", ibid., pp. 335-346.

M. G. Hebsur and R. H. Titran, "Tensile and Creep Rupture Behavior of P/M Processed Nb-Base Alloy, WC-3009", Refractory Metals: State-of-the-Art 1988, P. Kumar and R. L. Ammon, eds., TMS, Warrendale, Pa. (1989) pp. 39-48.

M. R. Jackson, P. A. Siemers, S. F. Rutkowski, and G. Frind, "Refractory Metal Structures Produced by Low Pressure Plasma Deposition", ibid., pp. 107-118.

*Primary Examiner*—Upendra Roy

*Attorney, Agent, or Firm*—James Magee, Jr.

[57] ABSTRACT

The alloy is preferably an alloy having a niobium and titanium base according to the expression:

$$Nb\text{-}Ti_{27\text{-}40.5}\text{-}Al_{4.5\text{-}10.5}\text{-}Hf_{1.5\text{-}5.5}Cr_{4.5\text{-}7.9}V_{0\text{-}6},$$

wherein the ratio of concentrations of Ti to Nb (Ti/Nb) is greater than or equal (≧) to 0.5, and wherein the maximum concentration of the Hf+V+Al+Cr additives is less than or equal (≦) to the expression:

$$16.5+(5\times Ti/Nb),$$

and the minimum concentration of these additives is 10.5.

The crystal form of the alloy is specifically body centered cubic crystal form.

6 Claims, 6 Drawing Sheets

NBTIALCRHF ALLOY AND STRUCTURES

CROSS REFERENCE TO RELATED APPLICATIONS

The subject applications relate to the copending application as follows:

Ser. No. 07/907,949 (Attorney Docket RD-20, 457), filed Jul. 2, 1992; Ser. No. 07/816,165 (Attorney Docket RD-21,593), filed Jan. 2, 1992; Ser. No. 07/816,164 (Attorney Docket RD-21,594), filed Jan. 2, 1992; Ser. No. 07/815,794, (Attorney Docket RD-21,595), filed Jan. 2, 1992; Ser. No. 07/815,797 (Attorney Docket RD-21,596), filed Jan. 2, 1992; and Ser. No. 07/816,161 (Attorney Docket RD-21,597), Ser. No. 07/953,702 (Attorney Docket RD-22,137), filed Sep. 30, 1992; Ser. No. 07/953,700 (Attorney Docket RD-22, 138), filed Sep. 30, 1992; Ser. No. 07/953,701 (Attorney Docket RD-22,139), filed Sep. 30, 1992; Ser. No. 07,953,971 (Attorney Docket RD-22,140), filed Sep. 30, 1992; Ser. No. 07/953,907 (Attorney Docket RD-22,141), filed Sep. 30, 1992; and Ser. No. 07/953,910 (Attorney Docket RD-22, 142), filed Sep. 30, 1992.

The texts of these related applications are incorporated herein by reference.

BACKGROUND OF THE INVENTION

The present invention relates to a family of novel metal alloys having a lighter weight and better oxidation resistance than alloys with comparable melting range, and having a tensile strength greater than wrought Ni-base alloys at high temperature. It also relates to structures in which such novel alloys are a part.

The invention additionally relates to body centered cubic metal structures in which the metal is ductile at room temperature, but which retain significant tensile strength at high temperatures.

It is known that niobium base alloys have useful strength in temperature ranges at which nickel and cobalt base superalloys begin to show incipient melting. This incipient melting temperature is in the approximately 2300° to 2400° F. range. The use of the higher melting niobium base metals in advanced jet engine turbine hot sections would allow higher metal temperatures than are currently allowed. Such use of the niobium base alloy materials could permit higher flame temperatures within the engines and would also permit production of greater power at greater efficiency. Such greater power production at greater efficiency would be at least in part due to a reduction in cooling air requirements. Most niobium base alloys, particularly those which are commercially available, are subject to oxidation to a degree which makes their use in high temperature air atmospheric environments unacceptable because of the lack of reliable coatings.

Certain alloys having a niobium-titanium base have much lower densities of the range 6–7.3 grams per cubic centimeter. A group of such alloys are the subject matter of commonly owned U.S. Pat. Nos. 4,956,144; 4,990,308; 5,006,307; 5,019,334; and 5,026,522. Such alloys can be formed into parts which have significantly lower weight than parts formed of niobium based alloys or than presently employed nickel and cobalt superalloys as these superalloys have higher densities ranging from about 8 to about 9.3 grams per cubic centimeter.

One additional patent, U.S. Pat. No. 4,931,254, concerns an alloy having the following composition in atom percent:

| Ingredient | Concentration Range |
|---|---|
| niobium | balance |
| titanium | 40–48% |
| aluminum | 12–22% |
| hafnium | 0.5–6% |
| chromium | 3–8% |

Commonly owned U.S. Pat. No. 4,904,546 concerns an alloy system in which a niobium base alloy is protected from environmental attack by a surface coating of an alloy highly resistant to oxidation and other atmospheric attack.

In devising alloy systems for use in aircraft engines the density of the alloys is, of course, a significant factor which often determines whether the alloy is the best available for use in the engine application. The nickel and cobalt based superalloys also have much greater tolerance to oxygen exposure than the commercially available niobium based alloys. The failure of a protective coating on a nickel or cobalt superalloy is a much less catastrophic event than the failure of a protective coating on many of the niobium based alloys and particularly the commercially available niobium based alloys. The oxidation resistance of the niobium based alloys of the above commonly owned patents is intermediate between the resistance of commercial Nb base alloys and that of the Ni- or Co-based superalloys.

While the niobium titanium based alloys of the above commonly owned patents are stronger than wrought nickel or cobalt based superalloys at high temperatures, they are much weaker than cast or directionally solidified nickel based superalloys at these higher temperatures. However, for many engine applications, structures formed by wrought sheet fabrication are used, since castings of sheet structures cannot be produced economically in sound form for these applications.

What is highly desirable in general for aircraft engine use is an alloy which can be formed into a structure which has a combination of lower density, higher strength at higher temperatures, good ductility at room temperature, and higher oxidation resistance.

A number of articles have been written about use of refractory metals in high temperature applications. These articles include the following:

(1) S. T. Wlodek, "The Properties of Cb-Ti-W Alloys, Part I", Oxidation Columbium Metallurgy, D. Douglass and F. W. Kunz, eds., AIME Metallurgical Society Conferences, vol. 10, Interscience Publishers, New York (1961) pp. 175–204.

(2) S. T. Wlodek, "The Properties of Cb-Al-V Alloys, Part I", Oxidation ibid., pp. 553–584 .

(3) S. Priceman and L. Sama, "Fused Slurry Silicide Coatings for the Elevated Temperature Oxidation of Columbium Alloys", Refractory Metals and Alloys IV - TMS Conference Proceedings, French Lick, IN, Oct. 3–5, 1965, vol . II, R. I . Jaffee, G. M. Ault, J. Maltz, and M. Semchyshen, eds., Gordon and Breach Science Publisher, New York (1966) pp. 959–982.

(4) M. R. Jackson and K. D. Jones, "Mechanical Behavior of Nb-Ti Base Alloys", Refractory Metals: Extraction, Processing and Applications, K. C. Liddell, D. R. Sadoway, and R. G. Bautista, eds., TMS, Warrendale, PA (1990) pp. 311–320.

(5) M. R. Jackson, K. D. Jones, S. C. Huang, and L. A. Peluso, "Response of Nb-Ti Alloys to High Temperature Air Exposure", ibid., pp. 335–346.

(6) M. G. Hebsur and R. H. Titran, "Tensile and Creep Rupture Behavior of P/M Processed Nb-Base Alloy, WC-3009", Refractory Metals: State-of-the-Art 1988, P. Kumar and R. L. Ammon, eds., TMS, Warrendale, PA (1989) pp. 39–48.

(7) M. R. Jackson, P. A. Siemers, S. F. Rutkowski, and G. Frind, "Refractory Metal Structures Produced by Low Pressure Plasma Deposition", ibid., pp. 107–118.

BRIEF STATEMENT OF THE INVENTION

In one of its broader aspects, objects of the present invention can be achieved by providing a niobium titanium based metal having the following composition in atom percent:

$$Nb\text{-}Ti_{27\text{-}40.5}\text{-}Al_{4.5\text{-}10.5}\text{-}Hf_{1.5\text{-}5.5}Cr_{4.5\text{-}7.9}V_{0\text{-}6},$$

where the metal has a body centered cubic crystal structure, and wherein the ratio of concentrations of Ti to Nb (Ti/Nb) is greater than or equal (≧) to 0.5, and wherein the maximum concentration of the Hf+V+Al+Cr additives is less than or equal (≦) to the expression:

$$16.5+(5\times Ti/Nb), \text{ and}$$

the minimum concentration of these additives is 10.5, and wherein the balance is essentially niobium.

In another of its broader aspects, objects of the present invention can be achieved by providing an alloy having the following composition:

$$Nb\text{-}Ti_{27\text{-}40.5}\text{-}Al_{4.5\text{-}10.5}\text{-}Hf_{1.5\text{-}5.5}Cr_{4.5\text{-}7.9}V_{0\text{-}6}Zr_{0\text{-}1}C_{0\text{-}0.5},$$

where the metal has a body centered cubic crystal structure, and wherein the ratio of concentrations of Ti to Nb (Ti/Nb) is greater than or equal (≧) to 0.5, and wherein the maximum concentration of the Hf+V+Al+Cr additives is less than or equal (≦) to the expression:

$$16.5+(5\times Ti/Nb), \text{ and}$$

the minimum concentration of these additives is 10.5, and wherein the balance is essentially niobium.

As used herein the term balance essentially means that the balance of the metal is predominantly niobium but that it may contain small concentrations of the impurities which are inevitably found in refractory metal compositions. Such impurities which may be present include small concentrations of such metals as iron, manganese, silicon and other such common impurities. In addition the term balance essentially means that a number of low level additives, other than those specified above, may be present where the presence of the additive does not detract from the beneficial properties of the alloy.

BRIEF DESCRIPTION OF THE DRAWINGS

The description which follows will be understood with greater clarity if reference is made to the accompanying drawings in which.

DETAILED DESCRIPTION OF THE INVENTION

Figure 1:
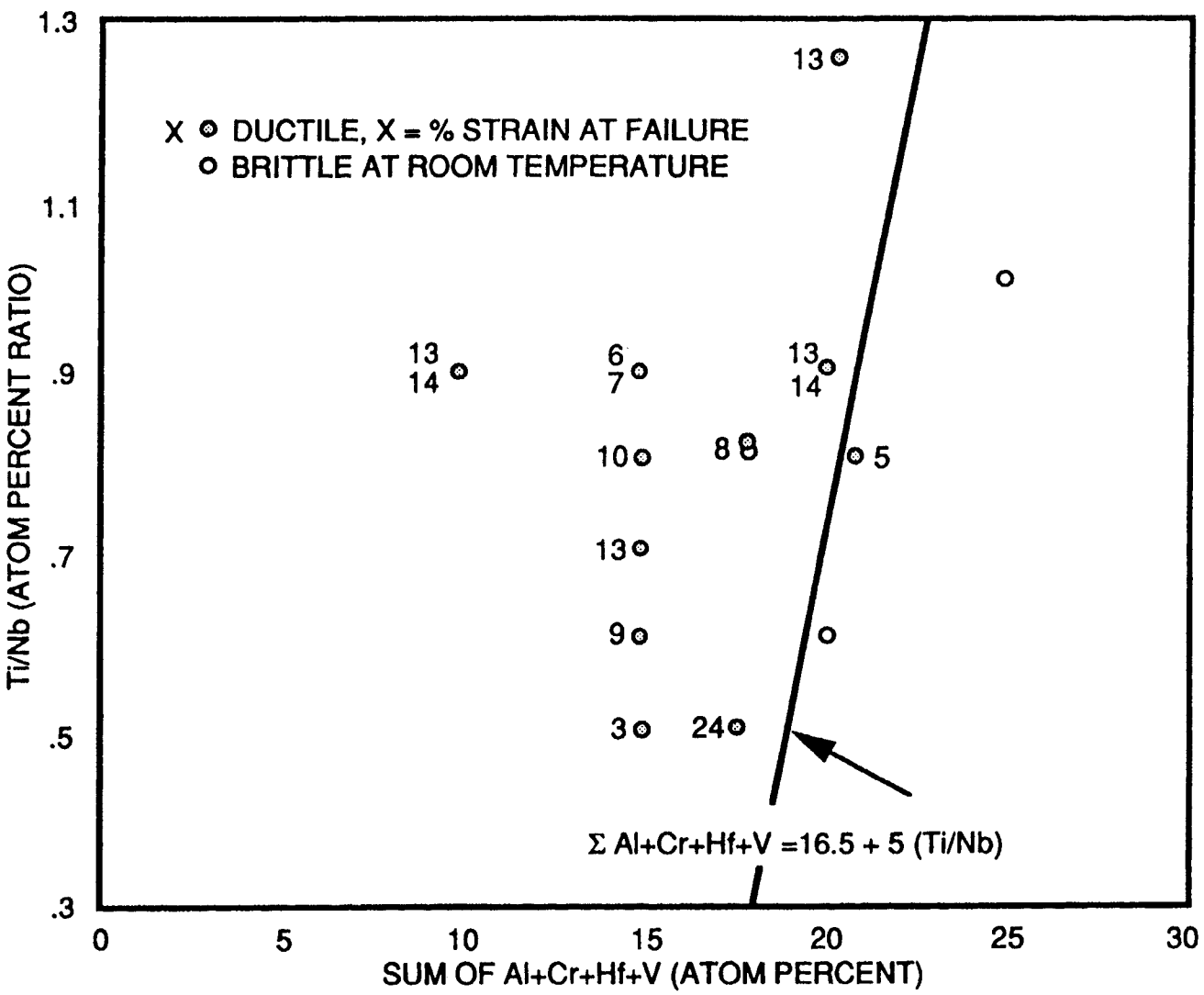
FIG. 1 shows those alloys for which concentration of Ai+Cr+Hf+V sums to no more than 16.5+5(Ti/Nb) generally are ductile at room temperature. Such alloys typically show fracture strains at room temperature of at least 5%.

Pursuant to the present invention, structures are formed incorporating strong, ductile, metallic, oxygen-resistant alloys.

The compositions are niobium base alloys in that the element present in highest concentration is niobium so that each of the compositions is high in niobium metal and has body centered cubic crystal structure.

The following examples illustrate some of the alloys of the present invention.

EXAMPLE 1

A metal identified as Alloy 6 with a titanium to niobium ratio of 0.5 was prepared by casting and extruding.

The alloy contained 27.5 atom percent of titanium, 5.5 atom percent aluminum, 6 atom percent chromium, 3.5 atom percent hafnium, and 2.5 atom percent vanadium and the balance niobium according to the expression:

$$Nb\text{-}Ti_{27.5}\text{-}Al_{5.5}\text{-}Cr_{6}\text{-}Hf_{3.5}\text{-}V_{2.5}.$$

Tensile results for Alloy 6 are listed in Table I, and rupture results in Table II.

TABLE I

Tensile Results of Alloy 6

| Ex. Sample | Alloy | Temp (C.) | Strength YS (ksi) | Strength UTS (ksi) | Elongation $EL_{ML}$ (%) | Elongation $EL_F$ (%) | RA (%) |
|---|---|---|---|---|---|---|---|
| 91-32 | Alloy 6 | 23 | 132.4 | 132.4 | 0.1 | 23.5 | 46.0 |
| 91-32 | Alloy 6 | 760 | 83.1 | 92.1 | 1.7 | 48.3 | 64.0 |
| 91-32 | Alloy 6 | 980 | 42.1 | 42.7 | 0.3 | 95.2 | 95.0 |
| 91-32 | Alloy 6 | 1200 | 20.4 | 20.4 | 0.2 | 83.2 | 57.0 |

In the above table:
YS designates yield strength in ksi (1000 pounds/in$^2$).
UTS designates ultimate tensile strength in ksi.
$EL_{ML}$ designates elongation (or strain) at maximum load (also known as uniform strain) in percent.
$EL_F$ designates elongation (or strain) at failure (also known as fracture strain).
RA designates reduction of area in percent.

TABLE II

| Ex. Sample | Alloy | Rupture Results Temperature (C.) | Stress (ksi) | Life hours |
|---|---|---|---|---|
| 91-32 | Alloy 6 | 980 | 12.50 | 1.86 |
| 91-32 | Alloy 6 | 1100 | 8.00 | 0.57 |

Alloy 6 could be cold rolled from 84 mils thickness to 55 mils thickness without intermediate annealing, after previous extrusion and hot rolling.

EXAMPLE 2

A metal powder was provided. The powder was a powder of a niobium based alloy having a titanium to niobium ratio of 0.82. The alloy, identified as alloy GAC, had the composition in atom percent as set forth in the following expression:

Alloy GAC: Nb-36.9Ti-8Cr-7.9Al-2Hf.

Powder of this alloy was prepared by conventional inert gas atomization processing.

A solid body of the alloy was produced by enclosing the powder in a billet and extrusion of the billet of GAC alloy powder. This extruded product was identified as 91-26.

To prepare this solid body, the powder was first poured into a decarburized steel can as the can was mechanically vibrated. When the pour was completed, the can was evacuated and sealed. The sealed can was then enclosed in a heavy walled stainless steel jacket to form a billet. The billet was then hot compacted to full density and was then hot extruded to achieve a 10:1 area reduction.

Accordingly by these procedures, the powder was consolidated by heat and pressure and the consolidated powder was then extruded to cause the particles of the powder to be deformed into elongated particles. After heat treatment, an equiaxed grain structure was attained.

Tensile tests were performed on the alloy and the results of these tests are set forth in Table III below.

TABLE III

| Ex. Sample | Alloy Matrix | Tensile Results of GAC Alloy Temp (C.) | YS (ksi) | UTS (ksi) | $EL_{ML}$ (%) | $EL_F$ (%) | RA (%) |
|---|---|---|---|---|---|---|---|
| 91-26/D | Alloy GAC | 23 | 144.5 | 144.5 | 0.1 | 8 | 22 |
| 91-26/C | Alloy GAC | 760 | 93.1 | 95.8 | 0.6 | 54 | 69 |
| 91-26/B | Alloy GAC | 980 | 29.2 | 29.2 | 0.2 | 112 | 95 |
| 91-26/A | Alloy GAC | 1200 | 10.9 | 10.9 | 0.2 | 207 | 97 |

A series of comparative rupture tests were also carried out on the structure and the results are set forth in Table IV below.

TABLE IV

| Ex. Sample | Alloy Matrix | Rupture Test Results for Alloy GAC Temperature (C.) | Stress (ksi) | Life hours |
|---|---|---|---|---|
| 91-26 | Alloy GAC | 980 | 12.50 | 1.05 |
| 91-26 | Alloy GAC | 1100 | 8.00 | 0.25 |

EXAMPLES 3-11

NbTi based bcc alloys have strengths significantly higher than currently used Ni and Co based wrought superalloys in the temperature regime above 1,000C. These alloys have coherent properties at temperatures extending beyond the melting points of the Ni and Co based alloys. The densities of the NbTi alloys are in the range of 6.0–7.3 g/cc, compared to the much higher densities of Ni and Co base alloys, typically 8.1–9.3 g/cc. The combination of higher strength and lower density in a ductile, cold workable material makes the NbTi alloys attractive for many high temperature jet engine applications.

Tensile data for compositions of additional NbTi alloys are given below in Table V.

TABLE V

| Ex. | Density (g/cc) | Ti/Nb | Al (atom percent) | Cr | Hf | Tensile Results for Examples 3-11 $YS/EL_F$ (ksi/%) Room T | $YS/EL_F$ (ksi/%) 760° C. | $YS/EL_F$ (ksi/%) 980° C. | $YS/EL_F$ (ksi/%) 1200° C. |
|---|---|---|---|---|---|---|---|---|---|
| 3 | 7.3 | 0.5 | 5 | 5 | 5 | 125/3 | 86/17 | 47/9 | 15/134 |
| 4 | 7.1 | 0.6 | 5 | 5 | 5 | 135/9 | 82/4 | 39/30 | 15/140 |
| 5 | 7.0 | 0.7 | 5 | 5 | 5 | 121/13 | 74/17 | 31/105 | 10/125 |
| 6 | 6.9 | 0.8 | 5 | 5 | 5 | 142/10 | 87/23 | 30/100 | 13/129 |
| 7 | 6.0 | 1.25 | 15 | 2.5 | 2.5 | 115/13 | 66/12 | 8/114 | 5/118 |
| 8 | 6.6 | 0.8 | 12 | 5 | 4 | 131/5 | 81/27 | 24/101 | |
| 9 | 7.0 | 0.6 | 10 | 4 | 6 | 108/NY | 79/45 | 33/58 | |
| 10 | 7.0 | 0.8 | 6 | 8 | 4(+.2C) | 55/NY | 89/NY | 37/9 | |
| 11 | 6.4 | 1.0 | 12 | 8 | 5 | 59/NY | 46/NY | 23/95 | |

NY = no yielding, sample failed elastically during loading

From this data (Examples 1-11), it is seen that ductile room temperature behavior can be expected for alloys with the following approximate composition:

$$Nb\text{-}Ti_{27\text{-}40.5}\text{-}Al_{4.5\text{-}10.5}\text{-}Hf_{1.5\text{-}5.5}Cr_{4.5\text{-}7.9}V_{0\text{-}6},$$

wherein the ratio of concentrations of Ti to Nb(Ti/Nb) is greater than or equal (≧) to 0.5, and wherein the maximum concentration of the Hf+V+Al+Cr additives is less than or equal (≦) to the expression:

$$16.5+(5\times Ti/Nb),$$

the minimum concentration of these additives is 10.5, and said alloy being ductile and having higher tensile and rupture strength at temperatures above 1,000 degrees centigrade.

Ductility at room temperature for examples 1–11, (Tables I, III and V) is plotted in FIG. 1. The plot shows the correlation of the ratio of Ti/Nb and the sum of Al+Cr+Hf+V to the plastic behavior of the alloy. All but one alloy to the left of the line plot of this Figure where:

$$\Sigma(Al+Cr+Hf+V)=16.5+5(Ti/Nb)$$

were ductile at room temperature. One alloy to the right of that line was ductile. Only two brittle alloys are shown on the plot, but it is known for simpler Nb-Ti-Al-Cr alloys that high Al+Cr levels lead to room temperature brittleness.

EXAMPLE 12–15

A series of four alloys were prepared by arc melting and extrusion. Each alloy contained 5a%Hf, 5a%V, 0.5a%Zr, and 0.2a%C, in an alloy for which the Ti/Nb ratio was 0.9. In addition, other elements were added as follows:

| | |
|---|---|
| alloy 3899-1 | no other addition |
| 3899-2 | 5a%Cr |
| 3899-3 | 5a%Cr+5a%Al |
| 3899-4 | 5a%Cr+5a%Al+2a%Sn |

The resulting compositions were according to the following expressions:

| | | | | | | | | | |
|---|---|---|---|---|---|---|---|---|---|
| 3899-1 | $Nb_{41}$ | $Ti_{42.3}$ | $Al_0$ | $Cr_0$ | $Hf_5$ | $V_5$ | $Zr_{0.5}$ | $C_{0.2}$ | |
| 3899-2 | $Nb_{44.4}$ | $Ti_{39.9}$ | $Al_0$ | $Cr_0$ | $Hf_5$ | $V_5$ | $Zr_{0.5}$ | $C_{0.2}$ | |
| 3899-3 | $Nb_{41.7}$ | $Ti_{37.6}$ | $Al_5$ | $Cr_0$ | $Hf_5$ | $V_5$ | $Zr_{0.5}$ | $C_{0.2}$ | |
| 3899-4 | $Nb_{40.7}$ | $Ti_{36.6}$ | $Al_0$ | $Cr_0$ | $Hf_5$ | $V_5$ | $Zr_{0.5}$ | $C_{0.2}$ | $Sn_2$ |

After extrusion, the alloys were heat treated at either 1300° C. (designated 13 in FIG. 2), or 1100° C.+1300° C. (designated 11/13 in FIG. 2), 2 hours at each temperature in argon, and were chamber cooled. Mechanical tests were performed on these alloys, and the results are shown in Table VI.

TABLE VI

TENSILE DATA FOR ALLOYS WITH Ti/Nb = 0.9

| | 1300° C. Heat Treatment | | | | | | 1100° C. + 1300° C. Heat Treatment | | | | |
|---|---|---|---|---|---|---|---|---|---|---|---|
| | YS | UTS | $EL_{ML}$ | $EL_F$ | % RA | TEMP | YS | UTS | $EL_{ML}$ | $EL_F$ | % RA |
| 3899-1 | 83.5 | 84.2 | 6.7 | 13 | 30 | 23 | 82.5 | 82.9 | 6.0 | 14 | 27 |
| Ex 12 | 50.3 | 53.7 | 2.0 | 33 | 29 | 760 | 48.1 | 51.5 | 2.0 | 29 | 53 |
| | 21.7 | 21.8 | 0.3 | 109 | 98 | 980 | 16.1 | 17.9 | 3.0 | 45 | 93 |
| | 7.3 | 8.4 | 1.6 | 121 | 97 | 1200 | 6.6 | 7.4 | 1.6 | 126 | 96 |
| 3899-2 | 113.8 | 117.1 | 4.1 | 5.6 | 8.3 | 23 | 111.7 | 114.7 | 4.8 | 6.6 | 14 |
| Ex 13 | 75.2 | 79.0 | 1.3 | 27 | 36 | 760 | 73.8 | 77.1 | 1.1 | 29 | 51 |
| | 27.9 | 28.0 | 0.3 | 122 | 97 | 980 | 27.6 | 28.4 | 0.4 | 89 | 95 |
| | 9.4 | 10.1 | 1.4 | 173 | 98 | 1200 | 8.1 | 9.1 | 1.2 | 121 | 97 |
| 3899-3 | 130.6 | 130.6 | 0.2 | 14 | 28 | 23 | 128.7 | 128.7 | 0.2 | 13 | 26 |
| Ex 14 | 85.8 | 86.8 | 0.5 | 55 | 71 | 760 | 86.4 | 87.6 | 0.6 | 47 | 64 |
| | 27.1 | 27.1 | 0.2 | 151 | 96 | 980 | 28.0 | 28.0 | 0.2 | 140 | 95 |
| | 5.7 | 6.2 | 2.3 | 162 | 98 | 1200 | 7.9 | 8.1 | 0.6 | 137 | 97 |
| 3899-4 | 144.7 | 144.7 | 0.2 | 14 | 24 | 23 | 142.0 | 142.0 | 0.2 | 9.4 | 24 |
| Ex 15 | 104.5 | 108.3 | 0.9 | 21 | 28 | 760 | 102.3 | 106.6 | 0.9 | 15 | 22 |
| | 28.7 | 28.7 | 0.3 | 144 | 96 | 980 | 29.6 | 29.6 | 0.4 | 129 | 94 |
| | 5.2 | 5.3 | 0.4 | 118 | 98 | 1200 | 7.9 | 8.5 | 0.5 | 73 | 97 |

Figure 2:
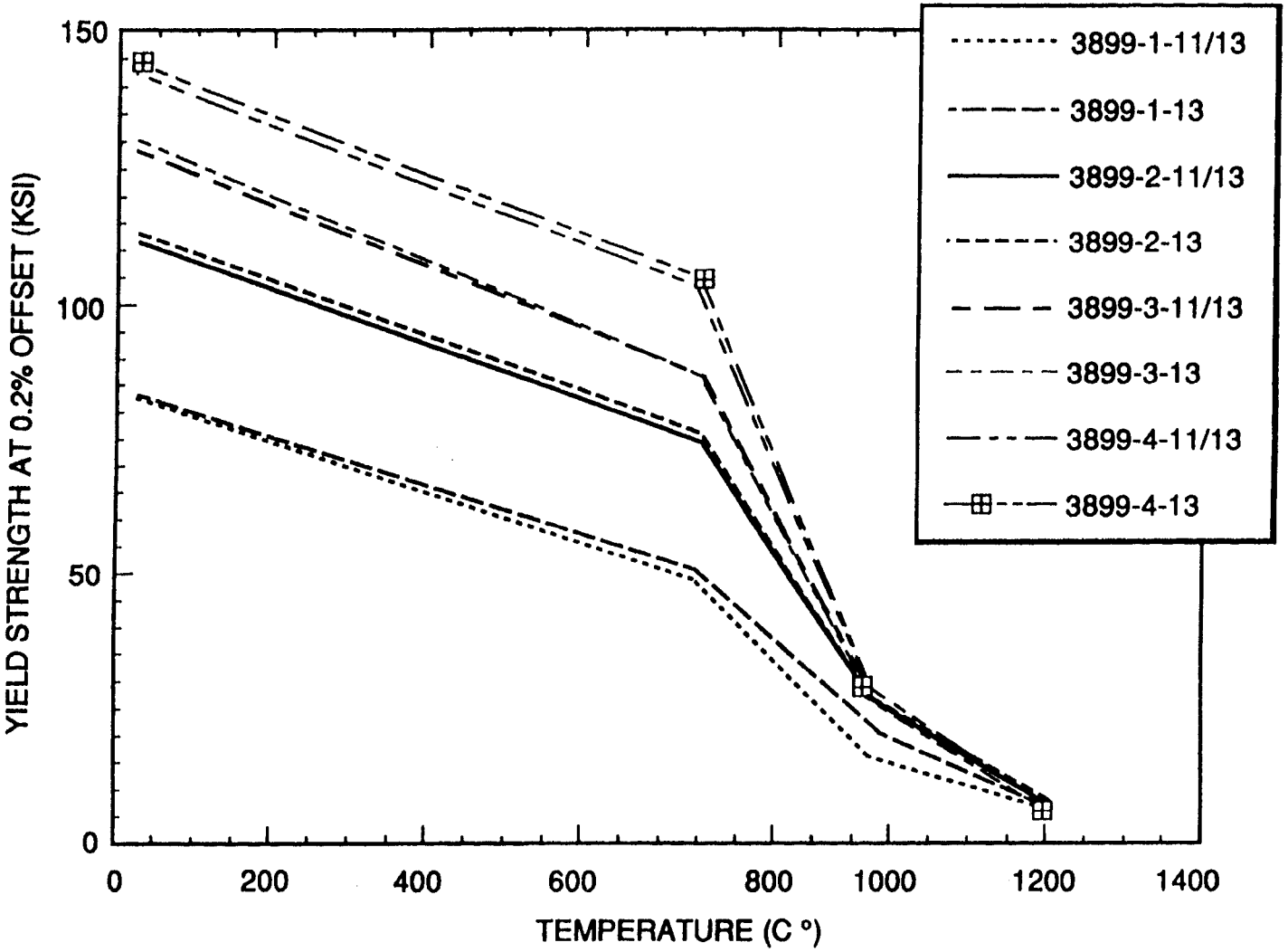
FIG. 2 is a plot of yield strength as a function of temperature for four NbTi base alloys in two heat treatment conditions.

Strength comparisons as a function of temperature are shown in FIG. 2. Although all four alloys are of essentially equivalent strength at temperatures of 1200° C. (2200° F.), their strengths show considerable variation at lower temperatures. At 760° C. (1400° F.) there is a factor of two difference in strength between the alloy free of additions (Example 12) as compared with the fully alloyed material (Example 15). The strengthening due to a 5a/o Cr addition (Example 13), and then by a subsequent 5a/oAl addition (Example 14) is obvious in the comparison of the measurement of properties of alloys 12, 13, and 14. Example 15, with further modification by Sn addition, also results in considerable low temperature strength increases.

Figure 3:
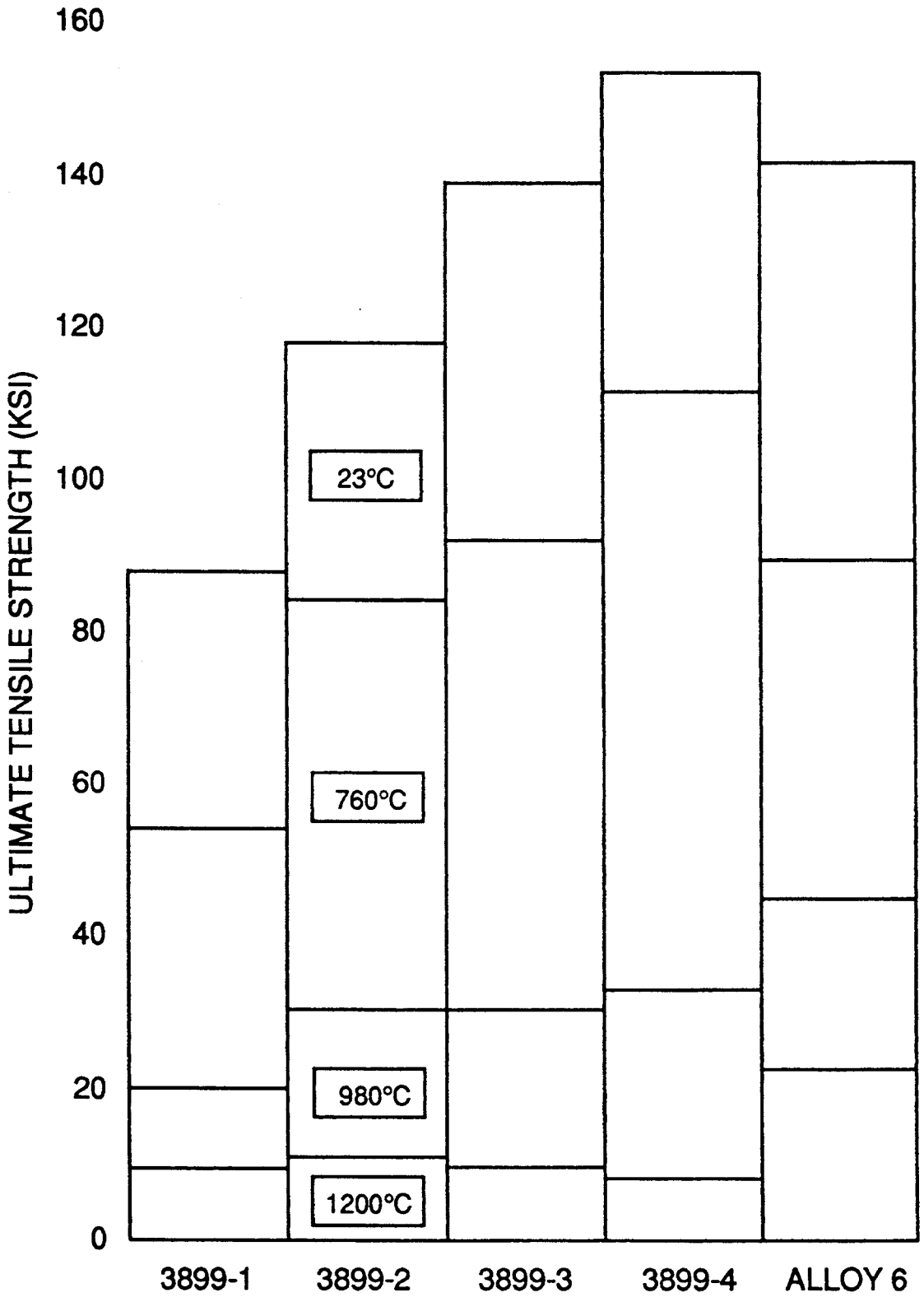
FIG. 3 is a comparison of ultimate strengths as a function of temperature between alloys of Examples 12–15 and the alloy of Example 1.

A comparison of alloy 6 (Example 1) with the above alloys is seen in FIG. 3. The similarities in chemistry in terms of Al, Cr, Hf, and V contents are such that the differences in behavior between the alloy of example alloy 14 and that of example alloy 1 is almost entirely reflective of differences in Ti/Nb ratios. Those two alloys show essentially identical strengths at 23 and 760° C. However, the alloy with Ti/Nb=0.5 is 1.5 times the strength at 980° C., and almost 3 times the strength at 1200° C., compared to the alloy with Ti/Nb=0.9.

Example alloy 14, with Ti/Nb=0.9, was arc melted to produce an ingot approximately 3" in diameter and 4½" high. A cylindrical piece was electrodischarge machined, vacuum canned in a molybdenum jacket, and hot extruded to a rectangular cross section with an approximately 7:1 reduction. While still in the molybdenum jacket, a piece of the extrusion was hot rolled in multiple passes to produce a sheet of 0.1" thickness. This sheet was reduced to 0.085" thickness when the molybdenum jacket was removed by etching in a nitric acid solution. After annealing at temperatures in the range of 1000–1100C, the alloy could be cold rolled for at least 50% elongation before requiring another annealing. Further cold rolling to 0.03" thickness was followed by a lower temperature annealing treatment, after which the 0.03" thick sheet could be bent cold at least 90 degrees around a mandrel of 0.06" radius. This example demonstrates the excellent cold deformation capability and room temperature ductility of such alloys. For compositions with lower Ti/Nb ratios, different annealing temperatures are required, and lesser reductions are possible between re-anneals, but cold deformation is achievable.

Figure 4:
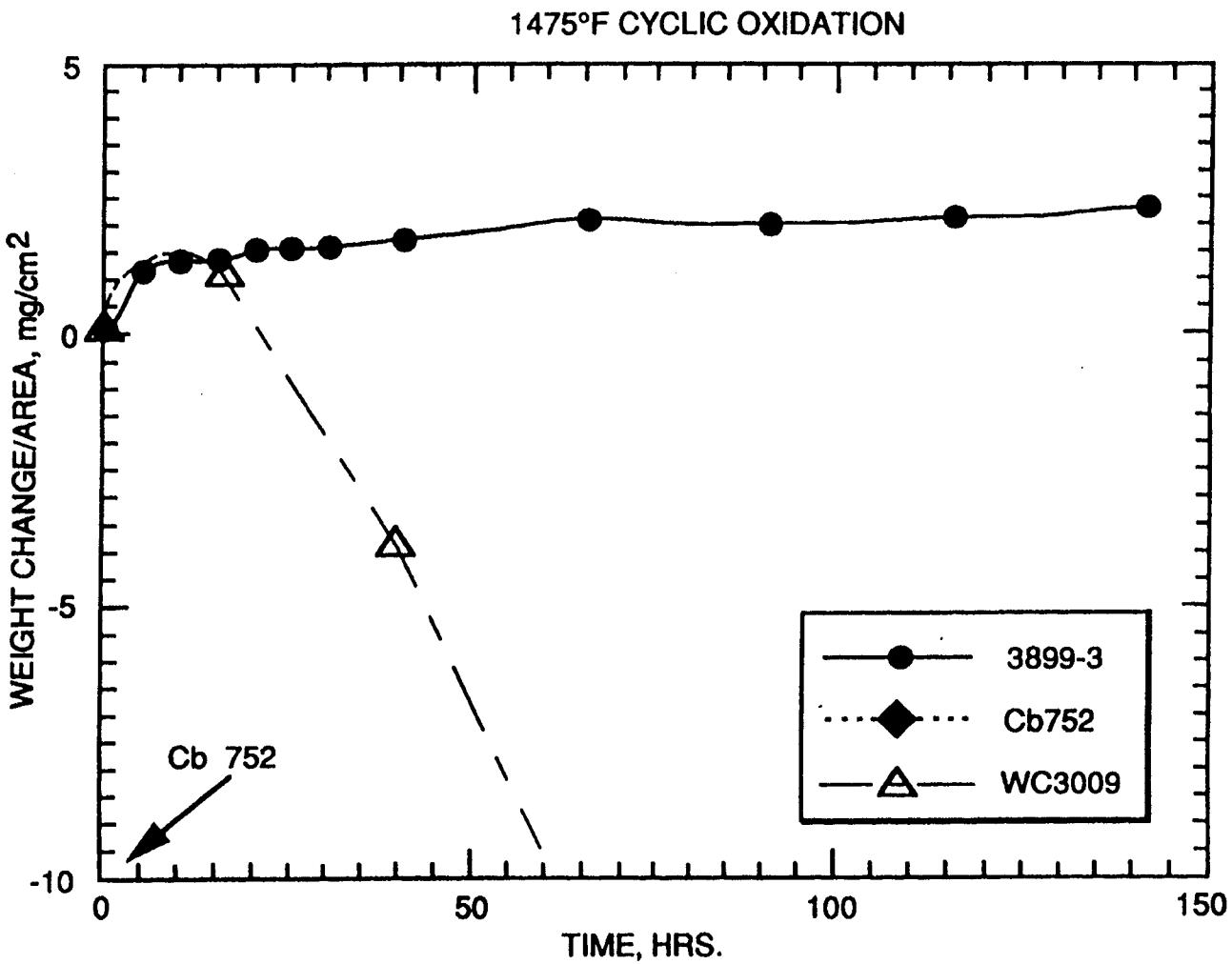
FIG. 4 is a comparison of oxidation behavior of Example 14 (3899-3) with conventional Nb alloys Cb-752 and WC3009.

Oxidation tests were carried out by exposing samples of example alloy 14 to 1475° F. air and cycling to room temperature. Results are shown in FIG. 4, together with results for the same exposure on commercial Nb alloys Cb-752 and WC3009. The Cb-752 alloy lost large amounts of weight due to oxidation and spallation, more than 10 mg/cm$^2$ in 2 hours exposure. The WC3009 was nearly as severely oxidized in 60 hours of exposure. The example alloy 14 is far more resistant to oxidation and spallation: after 140 hours exposure, the alloy showed only a small weight gain due to growth of oxide with essentially no spallation.

Rupture testing of example alloy 12 in sheet form in argon at 980° C./8ksi yielded lifetime of 98.8 hours, while at 1100° C./3ksi, tests were stopped after 2035 hours without failure. For refractory alloys, rupture data is commonly plotted to compare rupture stress to the quantity T(log t+15), where T is the absolute temperature, and t is the rupture life in hours. The constant, 15, allows tests at different temperatures to be described by a single rupture line. A similar relationship exists for Ni-base alloys, but the constant commonly employed has a value of 20. Thus, refractory metals and Ni alloys cannot be compared using a T(log t) description. However, data for each type of alloy can be compared on a common plot if rupture life is estimated from the T(log t) relations. The 980° C./98.8 h and 1100° C./2035+h tests yield values of T(log t+15) of 21,294 and 25,138 (using °K and hours). For a 1000 hour rupture life, log t+15 has the value of 18. The 1100° C./2035+h test would predict a 1124° C./1000+h test, while the 980° C./98.8 h test would predict a 910° C./1000 h test condition from T=(25,138/18)−273 and (21,138/18)−273, respectively.

Figure 5:
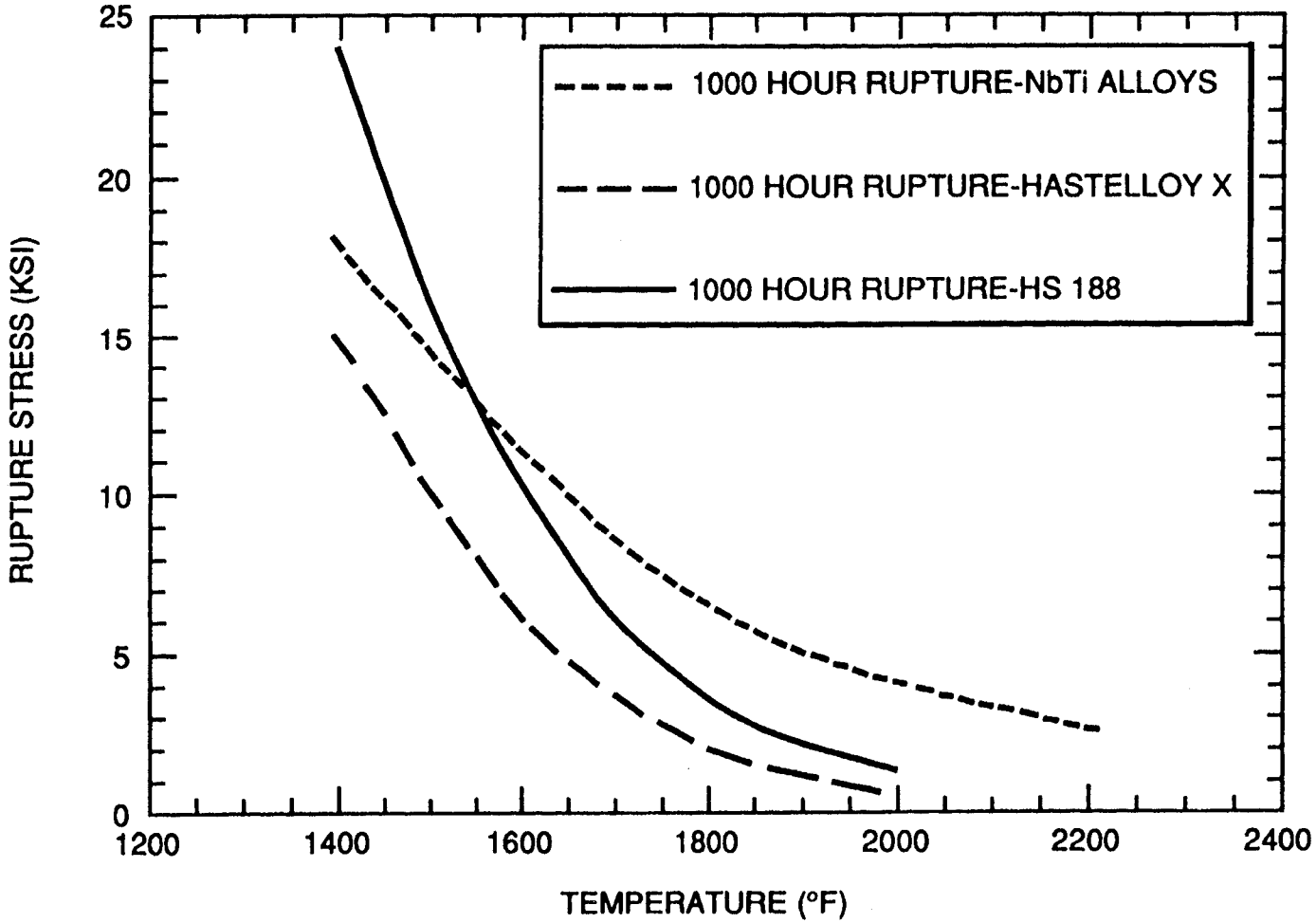
FIG. 5 is a rupture stress comparison for 1000 hour rupture lives in the alloys of the present invention in relation to Co and Ni wrought alloys.

Data for examples 1, 2, and 14 can be treated in an analogous fashion to predict temperatures which will yield rupture in 1000 hours, as a function of rupture stress. These values can then be compared directly for similar treatments of data for Ni or Co alloys. In FIG. 5, this comparison has been made for the alloys of the present invention compared to the Ni based alloy Hastelloy X, and the Co based alloy HS 188. At stresses below about 13 ksi, the alloys of this invention are clearly superior to the wrought alloys shown in the comparison. At 5 ksi, the alloys of this invention show an improvement of 250° F. over Hastelloy X, and 175° F. over HS 188. At lower stresses, the temperature differences are even greater. For stationary high temperature components, where mechanical stresses are small, the rupture resistance of the Nb-Ti alloys will allow much longer lifetimes than for cast and wrought Ni and Co based alloys.

Figure 6:
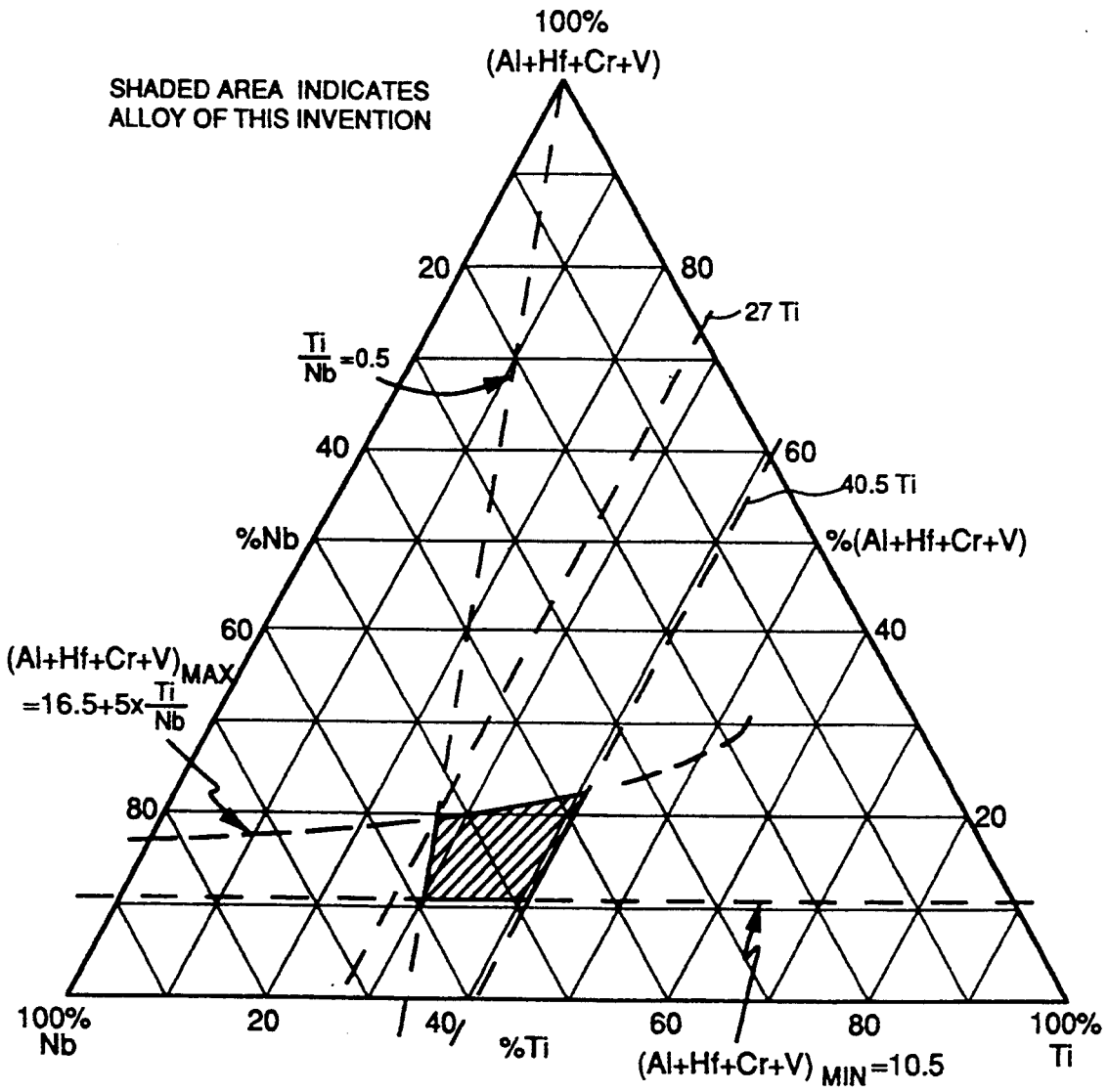
FIG. 6 is a schematic illustration of the composition boundaries of the alloys of the present invention.

The base compositions of the alloys of the invention are shown schematically in FIG. 6. The alloys should have a ratio of Ti/Nb of at least 0.5, to achieve good resistance to oxidation. For best high temperature strength and metallurgical stability, Ti contents should be limited to no more than 40.5a/o. For good strength at low temperature and good resistance to oxidation at high temperature, there should be additions of Al, Cr, Hf and V additives which sum at least 10.5%. Ductility at room temperature is generally achievable if the sum of the inclusion of those elements is no more than 16.5+5(Ti/Nb), in atom percent. In maintaining addition levels between 16.5+5(Ti/Nb) and the lower boundary of 10.5a/o, the levels of each individual addition element should be held to 4.5–10.5a/oAl, 1.5–5.5a/oHf, 4.5–7.9a/oCr, and 0–6a/oV to assure room temperature ductility and workability.

Examples 12–15 are alloys of the above description with further additions of Zr and C. These elements have been found to restrict grain growth to <250 μm during exposures to temperatures as high as 1200° C. (2200° F.). The restriction of grain growth is necessary to retain room temperature ductility for sheet structures where the sheet thickness is less than ~0.1 cm. Additions of 0–1 Zr and 0–0.5 C have been found to restrict grain growth without degrading the inherent strength and ductility of the alloy compositions of this invention.

What is claimed is:

1. An alloy having a composition consisting essentially of in atom percent according to the following expression:

$$Nb\text{-}Ti_{27\text{-}40.5}\text{-}Al_{4.5\text{-}10.5}\text{-}Hf_{1.5\text{-}5.5}Cr_{4.5\text{-}7.9}V_{0\text{-}6},$$

wherein the ratio of concentrations of Ti to Nb(Ti/Nb) is greater than or equal (≧) to 0.5, and wherein the maximum concentration of the Hf+V+Al+Cr additives is less than or equal (≦) to the expression:

$$16.5+(5\times Ti/Nb),$$

wherein the minimum concentration of the Hf+V+Al+Cr additives is 10.5, said alloy being ductile and having higher tensile and rupture strength at temperatures above 1,000 degrees centigrade, and wherein the balance is essentially niobium.

2. The alloy of claim 1, in which the composition is according to the following expression, $$Nb\text{-}Ti_{27\text{-}40.5}\text{-}Al_{4.5\text{-}10.5}\text{-}Hf_{1.5\text{-}5.5}Cr_{4.5\text{-}7.9}V_{0\text{-}6},$$

wherein the ratio of concentrations of Ti to Nb(Ti/Nb) is greater than or equal (≧) to 0.5, and wherein the maximum concentration of the Hf+V+Al+Cr additives is less than or equal (≦) to the expression:

$$16.5+(5\times Ti/Nb),$$

wherein the minimum concentration of these additives is 10.5, and wherein the balance is essentially niobium.

3. The alloy of claim 1, in which the composition is according to the following expression, $$Nb\text{-}Ti_{27\text{-}40.5}\text{-}Al_{4.5\text{-}10.5}\text{-}Hf_{1.5\text{-}5.5}Cr_{4.5\text{-}7.9}V_{0\text{-}6}Zr_{0\text{-}1}C_{0\text{-}0.5},$$

wherein the ratio of concentrations of Ti to Nb(Ti/Nb) is greater than or equal (≧) to 0.5, and wherein the maximum concentration of the Hf+V+Al+Cr additives is less than or equal (≦) to the expression:

$$16.5+(5\times Ti/Nb),$$

wherein the minimum concentration of these additives is 10.5, and wherein the balance is essentially niobium.

4. A structural member formed of an alloy of claim 1, in which the composition is according to the following expression:

$$Nb\text{-}Ti_{27\text{-}40.5}\text{-}Al_{4.5\text{-}10.5}\text{-}Hf_{1.5\text{-}5.5}Cr_{4.5\text{-}7.9}V_{0\text{-}6},$$

wherein the ratio of concentrations of Ti to Nb(Ti/Nb) is greater than or equal (≧) to 0.5, and wherein the maximum concentration of the Hf+V+Al+Cr additives is less than or equal (≦) to the expression:

$$16.5+(5\times Ti/Nb),$$

wherein the minimum concentration of the Hf+V+Al+Cr additives is 10.5, and wherein the balance is essentially niobium.

5. A structural member formed of an alloy of claim 1, in which the composition alloy is according to the following expression:

$$Nb\text{-}Ti_{27\text{-}40.5}\text{-}Al_{4.5\text{-}10.5}\text{-}Hf_{1.5\text{-}5.5}Cr_{4.5\text{-}7.9}V_{0\text{-}6}Zr_{0\text{-}1}C_{0\text{-}0.5},$$

wherein the ratio of concentrations of Ti to Nb(Ti/Nb) is greater than or equal (≧) to 0.5, and wherein the maximum concentration of the Hf+V+Al+Cr additives is less than or equal (≦) to the expression:

$$16.5+(5\times Ti/Nb),$$

wherein the minimum concentration of the Hf+V+Al+Cr additives is 10.5, and wherein the balance is essentially niobium.

6. A structural member formed of an alloy having a composition consisting essentially of in atom percent according to the following expression:

$$Nb\text{-}Ti_{27\text{-}40.5}\text{-}Al_{4.5\text{-}10.5}\text{-}Hf_{1.5\text{-}5.5}Cr_{4.5\text{-}7.9}V_{0\text{-}6},$$

wherein the ratio of concentrations of Ti to Nb(Ti/Nb) is greater than or equal (≧) to 0.5, and wherein the maximum concentration of the Hf+V+Al+Cr additives is less than or equal (≦) to the expression:

$$16.5+(5\times Ti/Nb),$$

wherein the minimum concentration of the Hf+V+Al+Cr additives is 10.5, wherein the balance is essentially niobium, and said alloy being ductile and having higher tensile and rupture strength at temperatures above 1,000 degrees centigrade.

* * * * *